US005187942A

United States Patent [19]

Komatsu et al.

[11] Patent Number: 5,187,942

[45] Date of Patent: Feb. 23, 1993

[54] REFRIGERANT OVERCHARGE PREVENTION SYSTEM

[75] Inventors: Syunji Komatsu, Isesaki; Masaru Kuribara, Tatebayashi; Kazumitsu Kobayashi, Iseaki, all of Japan

[73] Assignees: Sanden Corporation; Japan Electronic Control Systems Company, Ltd., both of Japan

[21] Appl. No.: 799,538

[22] Filed: Nov. 27, 1991

[30] Foreign Application Priority Data

Nov. 30, 1990 [JP] Japan ..... 2-337066

[51] Int. Cl.[5] ..... F25B 45/00

[52] U.S. Cl. ..... 62/149; 62/77; 62/292

[58] Field of Search ..... 62/77, 149, 292, 126, 62/127, 129

[56] References Cited

U.S. PATENT DOCUMENTS 3,729,949 5/1973 Talbot et al. ..... 62/149

4,796,436 1/1989 Voorhis et al. ..... 62/149

*Primary Examiner*—John Sollecito

*Attorney, Agent, or Firm*—Baker & Botts

[57] ABSTRACT

A refrigerant overcharge prevention system is applied to a refrigerant charging apparatus which has a refrigerant supply source and a refrigerant supply pipe connected to a refrigerant circuit of a cooling apparatus. The charging apparatus charges refrigerant into the refrigerant circuit while activating a compressor provided in the refrigerant circuit. The system comprises a refrigerant flow suppressing mechanism provided in the refrigerant supply pipe for preventing an excessive flow of refrigerant being charged, a refrigerant charge determining sensor provided in a high-pressure side path of the refrigerant circuit for determining whether the amount of charged refrigerant reaches a desired level by sensing a change of the state of refrigerant present in the refrigerant circuit, and a compressor deactivating circuit for deactivating the compressor in response to the determination of the refrigerant charge determining sensor. The refrigerant charge rate is appropriately suppressed by the refrigerant flow suppressing mechanism to prevent generation of an excessive amount of bubbles of refrigerant in the refrigerant circuit. Completion of a proper refrigerant charge can be precisely and easily detected by the refrigerant charge determining sensor.

20 Claims, 4 Drawing Sheets

REFRIGERANT OVERCHARGE PREVENTION SYSTEM

BACKGROUND OF THE INVENTION

1. Field of the Invention

The present invention relates to a refrigerant overcharge prevention system for precisely and easily detecting the finish of a proper refrigerant charge when refrigerant is charged into a refrigerant circuit of a cooling apparatus using a refrigerant charging apparatus.

2. Description of the Prior Art

Typical conventional cooling apparatus and refrigerant charging apparatus are constituted, for example, as shown in FIG. 11. The cooling apparatus has refrigerant circuit 1 formed from pipe 7. A refrigerant such as freon gas is circulated in refrigerant circuit 1. Compressor 2, condenser 3, receiver dryer 4, expansion valve 5 and evaporator 6 are provided in refrigerant circuit 1 sequentially in the circulation direction of the refrigerant which is shown by arrows. Refrigerant charging apparatus 8 comprises bomb 9 for storing refrigerant therein, gage manifold 10, having pressure gages 11, connected to the bomb via pipe 12 having valve 13, and refrigerant supply pipes 14, having valves 15, connected to refrigerant circuit 1.

In the refrigerant charging apparatus 8, the pressure of refrigerant to be supplied is controlled by valves 13 and 15 while the pressure is observed with pressure gages 11. In such a conventional refrigerant charging system, however, there are the following problems.

When refrigerant is charged, an operator terminates charging after recognizing by observation through a sight glass that bubbles of refrigerant (refrigerant in vapor phase) present in the liquid line of refrigerant circuit 1 or in receiver dryer 4 disappear. Namely, since the bubbles of refrigerant disappear when the amount of refrigerant present in refrigerant circuit 1 reaches a required amount, completion of the charge can be recognized by the state with no bubbles. However, if the rate of refrigerant charge is too fast, the bubbles of refrigerant do not disappear immediately after the amount of refrigerant present in refrigerant circuit 1 has reached a required amount. If the refrigerant charge is continued thereafter, an excessive amount of refrigerant is charged. It is difficult to prevent such an overcharge of refrigerant with the conventional system.

FIG. 9 shows the relationship between the amount of refrigerant charged into the refrigerant circuit and the pressure in the high-pressure side path of the refrigerant circuit. Although the pressure gradually increases as the amount of charged refrigerant increases, there exists an interval (A to B) in which the pressure is almost constant. This interval (A to B) constitutes an interval of proper refrigerant charge amounts. If refrigerant is further charged after the charged amount reaches point "B", the pressure again increases. If the charged amount exceeds point "C" which constitutes the upper limit of the charged amount for circuit 1, the pressure raises rapidly. Thus, the hatched area in the graph of FIG. 9 constitutes an overcharge area wherein the charged amount may cause malfunction of or damage to the cooling apparatus (for example point "D").

FIG. 10 shows the relationship between the refrigerant charge time and the amount of refrigerant charged into the refrigerant circuit. The marks "o" on the ends of the respective characteristic lines indicate points at which the bubbles of refrigerant disappear. As shown in FIG. 10, if the rate of refrigerant charge is too fast, the bubbles of refrigerant do not disappear until the charged amount enters into the overcharge area depicted by the hatch lines (for example, point "D"). Point "D" shown in FIG. 10 corresponds to the point "D" shown in FIG. 9. The interval of proper charge amounts is depicted by "R".

Thus, in the conventional system, since the time when the amount of charged refrigerant reaches a proper amount often differs from the time when the bubbles of refrigerant disappear, it is difficult to charge precisely a proper amount of refrigerant. Moreover, it is difficult to charge consistently refrigerant at an adequate rate in order to prevent inconsistency in refrigerant charge times.

SUMMARY OF THE INVENTION

Accordingly, an object of the present invention is to provide a refrigerant overcharge prevention system which can precisely and easily detect completion of a refrigerant charge of a proper amount and terminate the refrigerant charge before an overcharge occurs.

To achieve this object, the present invention provides a refrigerant overcharge prevention system as hereinafter described. The refrigerant overcharge prevention system is applied to a refrigerant charging apparatus which has a refrigerant supply source and a refrigerant supply path connected to a refrigerant circuit of a cooling apparatus and charges refrigerant stored in the refrigerant supply source into the refrigerant circuit through the refrigerant supply path while activating a compressor provided in the refrigerant circuit. The refrigerant overcharge prevention system comprises refrigerant charge determining means and compressor deactivating means. The refrigerant charge determining means is provided in a high-pressure side path of the refrigerant circuit for determining whether the amount of charged refrigerant reaches a target level (a required or proper amount) by sensing change of the state of refrigerant present in the refrigerant circuit from a mixing state of liquid and vapor phases to a liquid phase. The compressor deactivating means is coupled to the refrigerant charge determining means for deactivating the compressor in response to a determination of the refrigerant charge determining means. Preferably, the system further comprises refrigerant flow suppressing means provided in the refrigerant supply path for restricting the flow rate of refrigerant being charged into the refrigerant circuit to a rate lower than a predetermined level. The refrigerant flow suppressing means comprises, for example, an orifice, a path having an inner diameter smaller than that of the refrigerant supply path, a spiral pipe having a relatively large flow resistance, or a valve itself which is provided in the refrigerant supply path.

The refrigerant charge determining means comprises, for example, a self-exothermic type temperature detecting element or a photoelectric sensor. The self-exothermic type temperature detecting element, for example, a self-exothermic type thermistor, senses the state of refrigerant by measuring reduction of the temperature of the thermistor itself caused by thermal conduction from the thermistor to the refrigerant. The photoelectric sensor senses the state of refrigerant by measuring transmittance of a light transmitted through the high-pressure side path.

In the system according to the present invention, when the refrigerant is charged from the refrigerant supply source of the refrigerant charging apparatus into the refrigerant circuit of the cooling apparatus, the supplied refrigerant flows through the refrigerant flow suppressing means. The refrigerant flow suppressing means suppresses the flow rate of the refrigerant, and an excessive flow rate can be prevented. Therefore, an adequate flow rate of the refrigerant which is being charged can be maintained. As a result, there does not occur a large inconsistency between the time when the amount of charged refrigerant reaches a proper amount and the time when the bubbles of refrigerant generated in the refrigerant circuit disappear.

When the amount of charged refrigerant reaches a proper amount, the bubbles of refrigerant (refrigerant in vapor phase) in the refrigerant circuit naturally disappear in a short time. Namely, the state of refrigerant completely changes from a mixing state of liquid and vapor phases to a homogeneous liquid phase. This completion of refrigerant charge is detected by the refrigerant charge determining means. The refrigerant charge determining means determines the completion of the refrigerant charge by sensing that the entire charged refrigerant present in the refrigerant circuit enters the liquid phase. Since the determination is carried out not by observation but by the refrigerant charge determining means comprising, for example, a self-exothermic type temperature detecting element or a photoelectric sensor, it is very precise and reliable. That is, unskilled persons can recognize the completion of a proper refrigerant charge precisely and easily. In response to the determination of the refrigerant charge determining means, the compressor is automatically deactivated by the compressor deactivating means, and the refrigerant charge is properly carried out and terminated.

Preferred embodiments of the invention will now be described with reference to the accompanying drawings, which are given by way of example only, and are not intended to limit the present invention.

DETAILED DESCRIPTION OF THE PREFERRED EMBODIMENTS OF THE INVENTION

Figure 1:
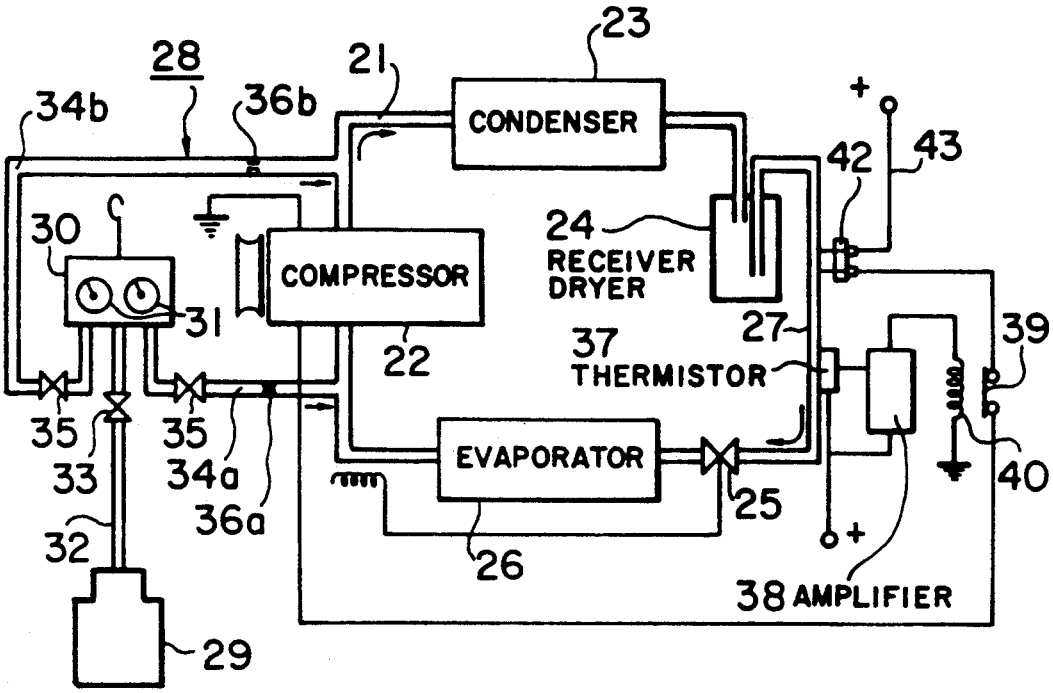
FIG. 1 is a schematic view of a refrigerant overcharge prevention system according to a first embodiment of the present invention including a refrigerant charging apparatus and a cooling apparatus.
Figure 2:
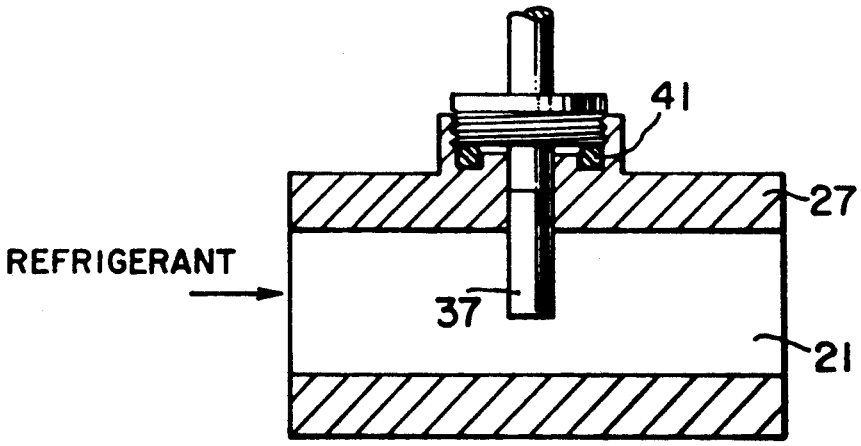
FIG. 2 is an enlarged sectional view of refrigerant charge determining means of the system shown in FIG. 1.
Figure 4:
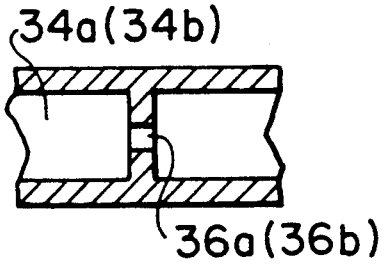
FIG. 4 is an enlarged sectional view of refrigerant flow suppressing means of the system shown in FIG. 1.

Referring to the drawings, FIGS. 1, 2 and 4 illustrate a refrigerant overcharge prevention system embodied in a refrigerant charging apparatus and a cooling apparatus according to a first embodiment of the present invention. In FIG. 1, a cooling apparatus has refrigerant circuit 21 formed from a pipe 27. A refrigerant such as freon gas is circulated in refrigerant circuit 21 when the apparatus is operated. Compressor 22, condenser 23, receiver dryer 24, expansion valve 25 and evaporator 26 are provided sequentially in refrigerant circuit 21 in the circulation direction of the refrigerant shown by arrows.

Refrigerant charging apparatus 28 has refrigerant bomb 29 provided as a refrigerant supply source which stores high-pressure refrigerant therein. Refrigerant bomb 29 is connected to gage manifold 30 via pipe 32. Gage manifold 30 has two gages 31 for sensing the pressure of charged refrigerant. Valve 33 is provided on pipe 32 for regulating the flow and pressure of refrigerant. Gage manifold 30 is connected to the low-pressure side and the high-pressure side of refrigerant circuit 21 via respective refrigerant supply paths 34*a* and 34*b* formed from pipes. Refrigerant supply paths 34*a* and 34*b* have valves 35 for regulating the flow and pressure of refrigerant. In this embodiment, orifices 36*a* and 36*b* are provided in the respective refrigerant supply paths 34*a* and 34*b* as refrigerant flow suppressing means for restricting the flow rate of refrigerant being charged into refrigerant circuit 21 to a rate lower than a predetermined level. Orifice 36*a* (36*b*) is formed, for example, as shown in FIG. 4.

Figure 5:
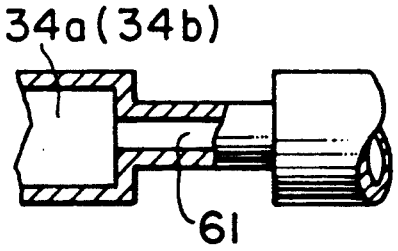
FIG. 5 is a sectional view of a second embodiment of refrigerant flow suppressing means of a refrigerant overcharge prevention system according to the present invention.
Figure 6:
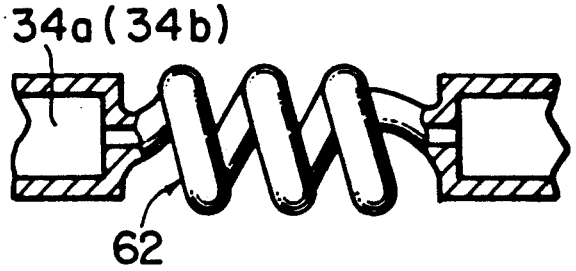
FIG. 6 is a partial sectional view of a third embodiment of refrigerant flow suppressing means of a refrigerant overcharge prevention system according to the present invention.

The refrigerant flow suppressing means can be formed by other means. For example, as shown in FIG. 5, the refrigerant flow suppressing means may comprise path 61 with an inner diameter smaller than that of refrigerant supply path 34*a* (34*b*). Alternatively, as shown in FIG. 6, the refrigerant flow suppressing means may comprise a spiral path 62 having a relatively large flow resistance. This spiral path 62 preferably has an inner diameter smaller than that of refrigerant supply path 34*a* (34*b*). Furthermore, the refrigerant flow suppressing means can be constituted by valves 35 themselves without providing additional suppressing. However, orifice 36*a* (36*b*), path 61 with a small inner diameter and spiral path 62 are more preferable as refrigerant flow suppressing means than valves 35 themselves, because, when the refrigerant flow suppressing means is constituted by valves 35 themselves, the control of the flow resistance is a little difficult and there is a possibility of an operation miss.

In FIG. 1, thermistor 37, a self-exothermic type thermistor, is provided in a high pressure-side path of refrigerant circuit 21 as refrigerant charge determining means. In this embodiment, thermistor 37 is provided at a position between receiver dryer 24 and expansion valve 25. Thermistor 37 is attached to pipe 27 via 0-ring 41, as shown in FIG. 2. Thermistor 37 mainly comprises an exothermic resistive body. Its electrical resistance becomes lower as its temperature elevates. The thermal conductivity of refrigerant has different values depending upon its phase, that is, depending upon whether it is in a liquid phase or vapor phase. For example, with freon-12, the thermal conductivity in liquid phase is 0.061 kcal/ m.hr.° C. and the thermal conductivity in vapor phase is 0.0083 kcal/m.hr.° C. If the refrigerant is in a mixed state of liquid phase and vapor phase, the thermal conductivity indicates an intermediate value therebetween. Therefore, the degree of reduction of the temperature of thermistor 37 exposed to refrigerant in a liquid phase is different from that of the thermistor exposed to refrigerant in a mixed phase. The output of thermistor 37 therefore corresponds to the phase state of the refrigerant. If refrigerant has not been sufficiently charged to a proper level, the refrigerant circulating in the refrigerant circuit indicates a mixed phase of liquid and vapor phases. If the amount of charged refrigerant has reached a target proper level, bubbles of refrigerant (refrigerant in vapor phase) in the refrigerant circulating in refrigerant circuit 21 disappear and the refrigerant indicates a liquid phase. The degree of reduction of the temperature of thermistor 37 changes depending upon the change of the phase of the refrigerant. Thermistor 37 can therefore detect completion of a proper refrigerant charge by sensing the phase state of the refrigerant.

Thermistor 37 is coupled to amplifier 38, as shown in FIG. 1. Amplifier 38 is connected to coil 40 of electromagnetic switch 39 provided in power source circuit 43 for the compressor. One terminal end of thermistor 37 is coupled to a power source, and the other terminal end is grounded through amplifier 38 and coil 40 of electromagnetic switch 39. If thermistor 37 detects that the degree of reduction of the temperature of the thermistor reaches a predetermined value, that is, determines completion of a proper refrigerant charge, the thermistor sends a signal to amplifier 38. The signal is amplified by amplifier 38, and the amplified signal excites coil 40 of electromagnetic switch 39. As a result, electromagnetic switch 39 is opened, compressor 22 is deactivated and the refrigerant charge operation is stopped.

Compressor 22 is driven via power source circuit 43 for the compressor. Pressure switch 42 is provided on the high-pressure side path of refrigerant circuit 21 at a position between receiver dryer 24 and expansion valve 25, and is attached to pipe 27. Pressure switch 42 is coupled to power source circuit 43 for the compressor in which electromagnetic switch 39 is incorporated. Pressure switch 42 detects the pressure of the refrigerant circulating in the high-pressure side path of refrigerant circuit 21 and sends a signal to open electromagnetic switch 39 for deactivating compressor 22 when the pressure switch detects a pressure higher than a predetermined value. In this embodiment, pressure switch 42 is provided as a back up switch for thermistor 37.

Figure 3:
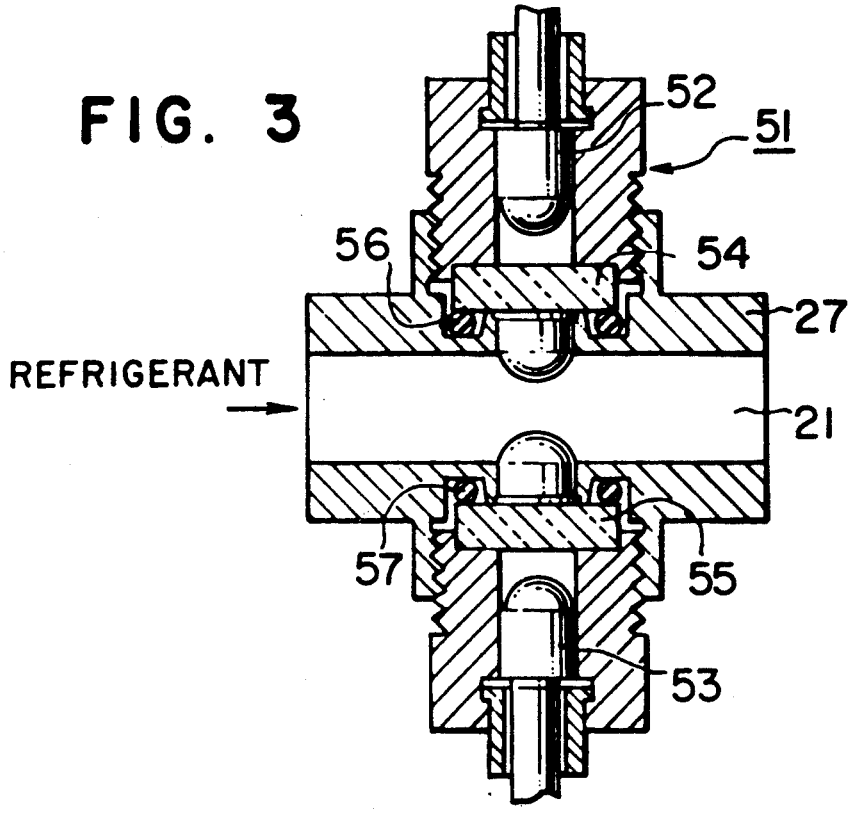
FIG. 3 is a sectional view of refrigerant charge determining means of a refrigerant overcharge prevention system according to a second embodiment of the present invention.

FIG. 3 illustrates another refrigerant charge determining means. In this embodiment, refrigerant charge determining means comprises a photoelectric sensor 51. Photoelectric sensor 51 senses the phase state of refrigerant by measuring transmittance of a light transmitted through the high-pressure side path of refrigerant circuit 21. Photoelectric sensor 51 includes emitter 52 emitting a light towards the high-pressure side path of refrigerant circuit 21 and receiver 53 for receiving the light transmitted through the path (and refrigerant in the path). Sensor 51 is attached to pipe 27 so that emitter 52 and receiver 53 confront each other. 0-rings 56 and 57 are interposed between sensor 51 and pipe 27 for sealing therebetween. The light emitted from emitter 52 is sent through sight glass 54 into the high-pressure side path, and the light transmitted through the high-pressure side path is received by receiver 53 through sight glass 55. Photoelectric sensor 51 detects transmittance of the light received by receiver 53. The transmittance of the light transmitted through the high-pressure side path of refrigerant circuit 21 corresponds to the mixing ratio of refrigerant in a liquid phase and refrigerant in a vapor phase existing or flowing in the high-pressure side path. As the amount of refrigerant increases, the ratio of refrigerant in a vapor phase to that in a liquid phase decreases and the transmittance of the light increases. Therefore, photoelectric sensor 51 can determine an increase in the amount of refrigerant by measuring transmittance of the light transmitted through the high-pressure side path. If photoelectric sensor 51 detects that the transmittance of the light reaches a predetermined value, the sensor sends a signal to switch 39 of circuit 43 through amplifier 38. The circuit 43 is opened, compressor 22 is deactivated and the refrigerant charging operation is stopped.

Figure 7:
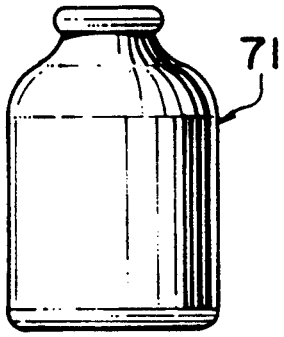
FIG. 7 is a side view of a first type of refrigerant supply source of a refrigerant overcharge prevention system according to the present invention.
Figure 8:
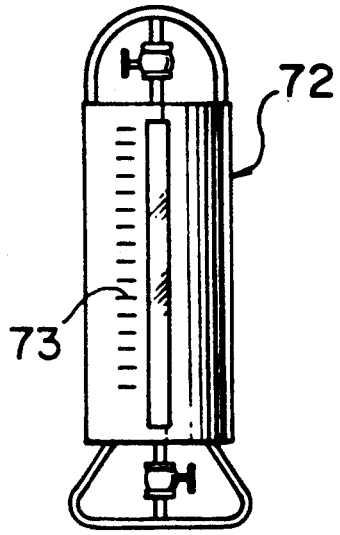
FIG. 8 is an elevational view of a second type of refrigerant supply source of a refrigerant overcharge prevention system according to the present invention.

In the refrigerant charging operation, refrigerant is supplied from bomb 29 of refrigerant charging apparatus 28. Although bomb 29 is used as a refrigerant supply source, other means can be employed. For example, a refrigerant bottle 71 (so-called service bottle) storing refrigerant therein, as shown in FIG. 7, can be used. Alternatively, a refrigerant charging cylinder 72 as shown in FIG. 8 also can be used. Refrigerant charging cylinder 72 has a scale 73 which can indicate the amount of remaining refrigerant therein or, conversely, the amount of refrigerant charged therefrom.

Figure 9:
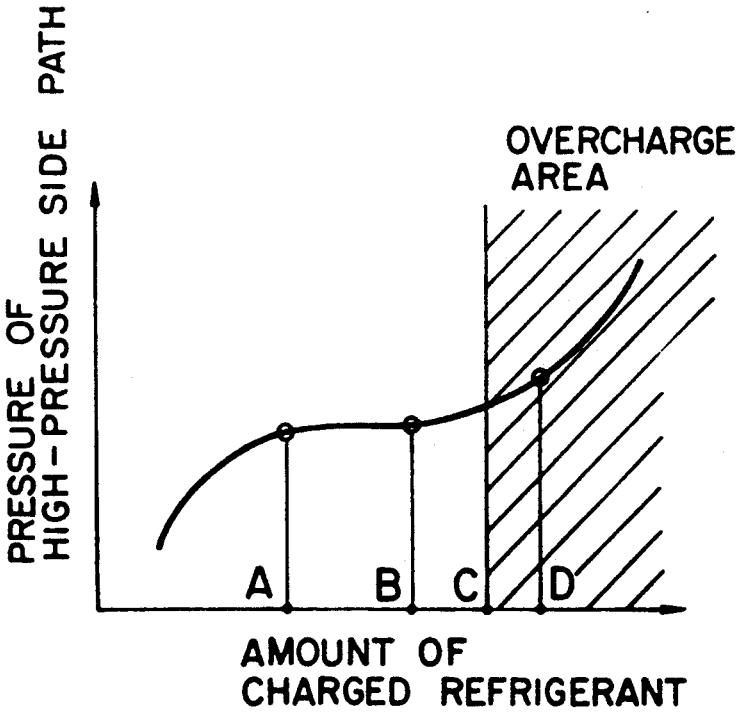
FIG. 9 is a graph showing the relationship between the amount of refrigerant charged into the refrigerant circuit and the pressure in the high-pressure side path of the refrigerant circuit in the systems shown in FIGS. 1 and 11.
Figure 10:
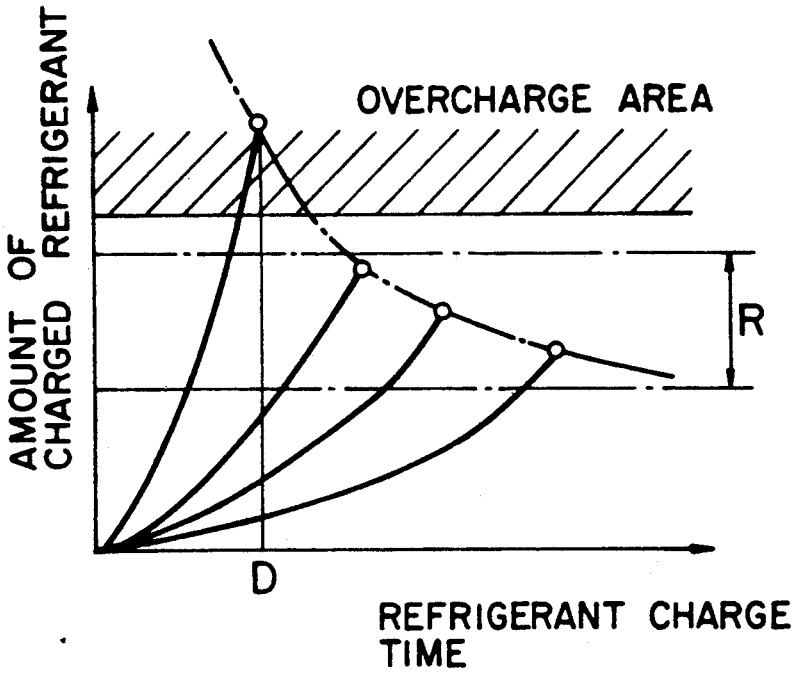
FIG. 10 is a graph showing the relationship between the refrigerant charge time and the amount of refrigerant charged into the refrigerant circuit in the systems shown in FIGS. 1 and 11.
Figure 11:
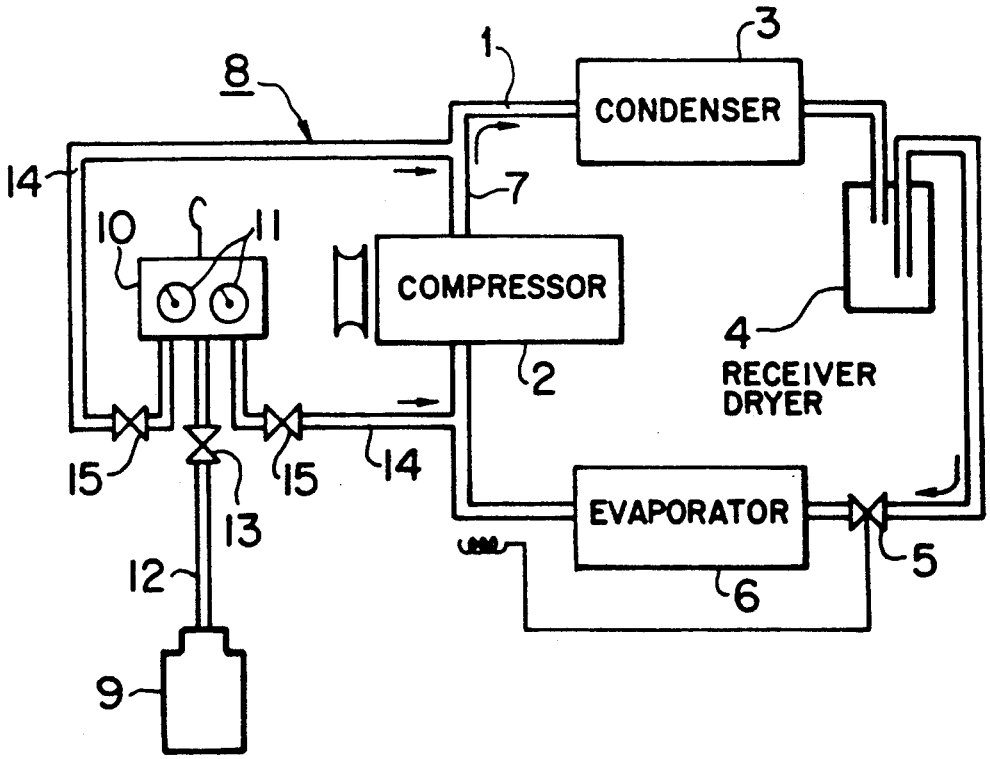
FIG. 11 PRIOR ART
FIG. 11 is a schematic view of a conventional cooling apparatus and refrigerant charging apparatus therefor.

As a refrigerant charging operation proceeds, the relationship between the amount of refrigerant charged into refrigerant circuit 21 and the pressure in the high-pressure side path of the refrigerant circuit forms a characteristic curve as shown in FIG. 9, as aforementioned. The interval between points "A" and "B" is an interval of proper amounts of charged refrigerant. The hatched area beyond point "C" is an overcharge area. FIG. 10 shows the relationship between the refrigerant charge time and the amount of refrigerant charged into refrigerant circuit 21. The marks "o" on the ends of the respective characteristic lines indicate points at which the bubbles of refrigerant (refrigerant in a vapor phase) disappear, as aforementioned.

In the present invention, since the refrigerant flow suppressing means suppresses the flow of charged refrigerant to a relatively low rate, the disappearance of bubbles generated in the refrigerant charged into refrigerant circuit 21 and circulating in the refrigerant circuit by compressor 22 almost coincides with (occurs very shortly after) attainment of a proper amount of refrigerant in circuit 21. Namely, the time when the amount of charged refrigerant reaches a required amount substantially coincides with the time when the phase of the charged refrigerant changes from a mixing state of liquid and vapor phases to a homogeneous liquid phase.

Under such a condition, the change of the phase of the charged refrigerant is precisely detected by thermistor 37 or photoelectric sensor 51. Therefore, a condition wherein the refrigerant charge is within the range of proper amounts (for example, range "R" shown in FIG. 10) is determined. Compressor 22 is deactivated in response to the determination of the sensor. Thus, an overcharge of refrigerant is prevented, and the charge of refrigerant is stopped with an adequate amount of refrigerant present in refrigerant circuit 21.

Although several preferred embodiments of the present invention have been described herein in detail, it will be appreciated by those skilled in the art that various other embodiments, as well as modifications and alterations to the described embodiments may be made without materially departing from the novel teachings and advantages of this invention. Accordingly, it is to be understood that all such other embodiments, modifications and alterations are included within the scope of the invention as defined by the following claims.

What is claimed is:

1. In a refrigerant charging apparatus which has a refrigerant supply source and a refrigerant supply path connected to a refrigerant circuit of a cooling apparatus and which charges refrigerant stored in said refrigerant supply source into said refrigerant circuit through said refrigerant supply path while activating a compressor provided in said refrigerant circuit, a refrigerant overcharge prevention system comprising:

refrigerant charge determining means, provided in a high-pressure side path of said refrigerant circuit, for determining whether the amount of charged refrigerant has reached a target level by sensing a change of state of refrigerant present in said refrigerant circuit from a mixing state of liquid and vapor phases to a liquid phase; and compressor deactivating means, coupled to said refrigerant charge determining means, for deactivating said compressor in response to determination of said refrigerant charge determining means.

2. The refrigerant overcharge prevention system according to claim 1, further comprising refrigerant flow suppressing means, provided in said refrigerant supply path, for restricting a flow rate of refrigerant being charged into said refrigerant circuit to a rate lower than a predetermined level.

3. The refrigerant overcharge prevention system according to claim 1, wherein said refrigerant charge determining means comprises a self-exothermic type temperature detecting element.

4. The refrigerant overcharge prevention system according to claim 3, wherein said self-exothermic type temperature detecting element is a self-exothermic type thermistor.

5. The refrigerant overcharge prevention system according to claim 1, wherein said refrigerant charge determining means comprises a photoelectric sensor which senses said state of refrigerant by measuring transmittance of a light transmitted through said high-pressure side path.

6. The refrigerant overcharge prevention system according to claim 5, wherein said photoelectric sensor comprises an emitter for emitting said light and a receiver for receiving the light transmitted through said path.

7. The refrigerant overcharge prevention system according to claim 2, wherein said refrigerant flow suppressing means comprises an orifice.

8. The refrigerant overcharge prevention system according to claim 2, wherein said refrigerant flow suppressing means comprises a path with an inner diameter smaller than that of said refrigerant supply path.

9. The refrigerant overcharge prevention system according to claim 2, wherein said refrigerant flow suppressing means comprises a spiral pipe.

10. The refrigerant overcharge prevention system according to claim 9, wherein said spiral pipe has an inner diameter smaller than that of said refrigerant supply path.

11. The refrigerant overcharge prevention system according to claim 2, wherein a valve is provided in said refrigerant supply path, and said refrigerant flow suppressing means is constructed from said valve itself.

12. The refrigerant overcharge prevention system according to claim 1, wherein said compressor deactivating means comprises a switch provided in a power source circuit for said compressor and an amplifier connected to said refrigerant charge determining means and said switch.

13. The refrigerant overcharge prevention system according to claim 12, wherein said switch is an electromagnetic switch, and said amplifier is connected to a coil of said electromagnetic switch.

14. The refrigerant overcharge prevention system according to claim 1, wherein said refrigerant circuit includes a compressor, a condenser, a receiver dryer, an expansion valve and an evaporator, and said refrigerant charge determining means is provided at a position between said receiver dryer and said expansion valve.

15. The refrigerant overcharge prevention system according to claim 1, wherein said refrigerant supply source comprises a refrigerant bomb.

16. The refrigerant overcharge prevention system according to claim 1, wherein said refrigerant supply source comprises a refrigerant bottle.

17. The refrigerant overcharge prevention system according to claim 1, wherein said refrigerant supply source comprises a refrigerant charging cylinder.

18. The refrigerant overcharge prevention system according to claim 17, wherein said refrigerant charging cylinder has a scale indicating an amount of remaining refrigerant in said cylinder.

19. The refrigerant overcharge prevention system according to claim 1, further comprising a pressure sensor provided in said high-pressure side path of said refrigerant circuit.

20. The refrigerant overcharge prevention system according to claim 19, wherein said pressure sensor is provided as a back up sensor of said refrigerant charge determining means.

* * * * *